US005311617A

United States Patent [19]

Ammatelli et al.

[11] Patent Number: 5,311,617

[45] Date of Patent: May 17, 1994

[54] PHYSIOLOGIC TOILET ATTACHMENT

[76] Inventors: Francis J. Ammatelli, 1235 W. 57th Ter., Kansas City, Mo. 64113; Edward L. McMullen, 10004 Walnut Dr., Kansas City, Mo. 64114

[21] Appl. No.: 868,880

[22] Filed: Apr. 16, 1992

[51] Int. Cl.[5] ..... A47K 13/00

[52] U.S. Cl. ..... 4/237; 4/254

[58] Field of Search ..... 4/235, 239, 241, 254, 4/234, 237

[56] References Cited

U.S. PATENT DOCUMENTS 559,304 4/1896 Muckenhirn .
906,053 12/1908 McAuliffe .
2,667,802 2/1954 Harris ..... 4/239
2,698,440 1/1955 Lyons .
2,954,566 10/1960 Lottenberg ..... 4/254
3,383,714 11/1965 Minasian et al. .
4,254,514 3/1981 Sakamoto .
4,466,140 8/1984 Sakamoto .

FOREIGN PATENT DOCUMENTS 9106239 5/1991 World Int. Prop. O. ..... 4/239

*Primary Examiner*—Charles E. Phillips
*Attorney, Agent, or Firm*—Kokjer, Kircher, Bowman & Johnson

[57] ABSTRACT

A toilet attachment for placing the user in the proper crouched configuration for bowel movement. Various embodiments are disclosed. Certain embodiments lift the legs of the user by a bar under the knees or feet. Other embodiments provide a tilting seat.

3 Claims, 4 Drawing Sheets

PHYSIOLOGIC TOILET ATTACHMENT

BACKGROUND OF THE INVENTION

1. Field of the Invention

The present invention relates in general to toilets or water closets. In particular, the present invention relates to an improved attachment for a standard toilet which will allow the user to assume a physiologically correct position for bowel movement.

2. Description of the Related Art

Toilets or water closets are typically designed with a seat which extends in a substantially horizontal plane. This forces the user to a sitting position in which the trunk of the body extends substantially vertically and the thighs extend substantially horizontally. This is despite the fact that it has been known for many years that a crouching position, in which the legs are elevated such that the thighs extend at an angle and approach the trunk of the body, is the proper physiologic position for a bowel movement, as this position straightens the colon.

Various arrangements have been proposed to allow the user to assume such a crouched position. For example, U.S. Pat. No. 559,304 to Muckenhirn and U.S. Pat. No. 906,053 to McAuliffe both propose toilets in which the entire bowl is formed to facilitate such a position. However, both of these arrangements would require the user to replace existing toilets, and both would present problems for the user to mount and dismount the toilet. This problem in mounting is especially aggravated for the elderly, which may most benefit by the crouched position.

U.S. Pat. No. 4,254,514 to Sakamoto discloses a toilet seat and foot rest which would replace the standard seat on a typical toilet. While this arrangement does not require the replacement of the existing toilet, the mounting and dismounting problems are still present, and the footrest will interfere with passage in front of the toilet. Similar problems are associated with the device proposed in U.S. Pat. No. 4,466,140 to Sakamoto, which discloses a footrest which attaches to the front of a standard toilet and fits beneath the standard toilet seat, raising the seat in the front. A further footrest attachment is shown in U.S. Pat. No. 2,298,440 to Lyons. This arrangement reduces the problems associated with the foot rest extending outwardly from the toilet, by pivoting the foot rest such that it may be lowered to an inoperative and space saving position. However, the foot rest is maintained in the operative position by engagement with the toilet rim, causing an unsanitary arrangement for a user when moving the device between the operative and inoperative positions.

SUMMARY OF THE INVENTION

An object of the present invention is to provide an attachment for an existing toilet which will allow the user to attain the physiologically correct crouched position while seated thereon.

Another object of the present invention is to provide such a device which does not interfere, and may assist, in the user mounting and dismounting the toilet.

Another object of the present invention is to provide such an attachment which does not, or may be moved to a position in which it does not, extend outwardly from the toilet and interfere with passage thereby.

Yet another object of the present invention is to provide such an attachment which is sanitary.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
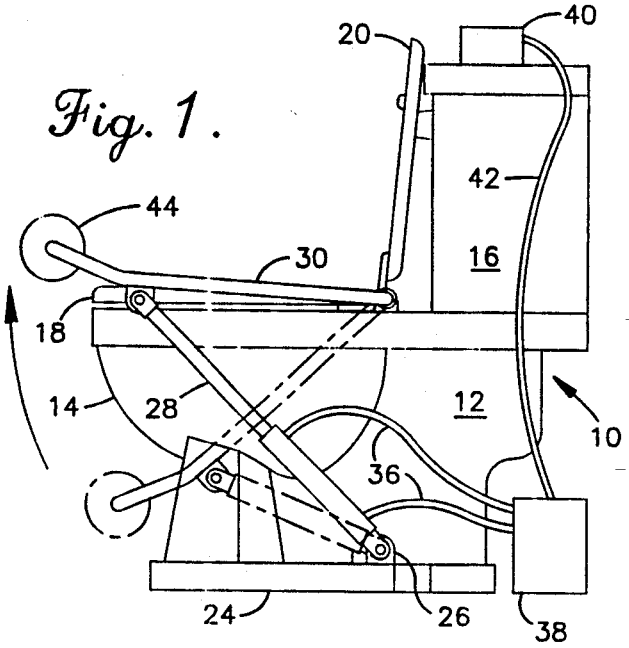
FIG. 1 is a side view of a first embodiment of the present invention.
Figure 3:
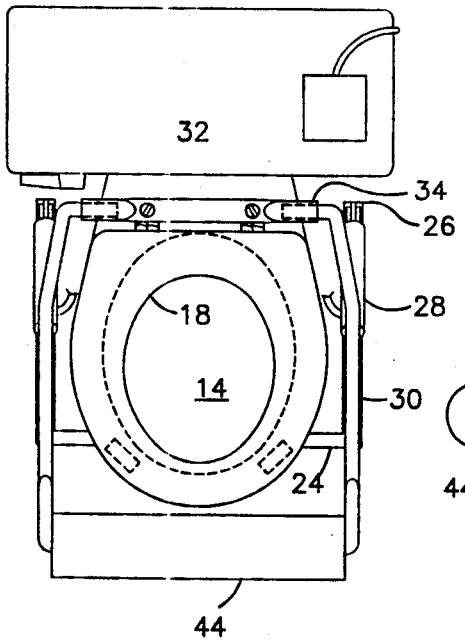
FIG. 3 is a top view of the embodiment of FIG. 1.

With reference to FIG. 1, a standard toilet or water closet is generally designated by reference numeral 10. The toilet 10 includes a base 12 which supports, and is typically integral with, a bowl 14 adapted to receive waste. The base 12 also supports a tank 14 which acts as water reservoir to remove the waste from the bowl 14. As is best shown in FIG. 3, the bowl 14 includes a semicircular opening which is at least partially surrounded by a seat 18 which is typically pivoted at the rear so that it may be raised and lowered out of position. Finally, the toilet 10 includes a cover 20 pivoted about the same axis as seat 18 such that it too may be raised and lowered out of position.

Figure 2:
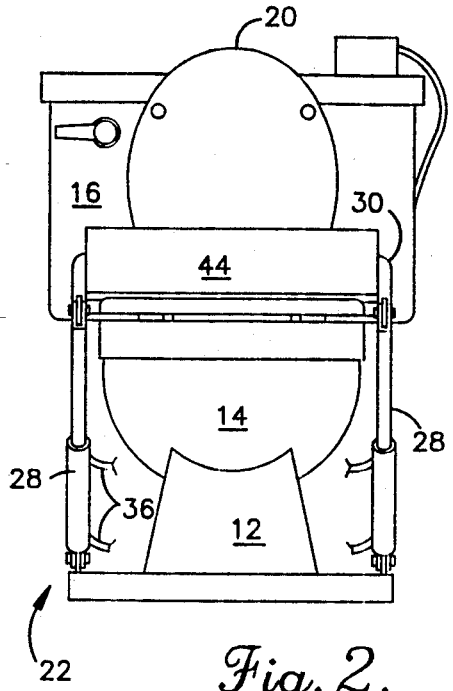
FIG. 2 is a front view of the embodiment of FIG. 1.

With reference to FIGS. 1 to 3, a first embodiment of the present invention is generally designated by reference numeral 22. The device 22 includes a base 24 having a general U-shape with the legs of such U extending rearwardly from the bowl towards the tank, such that the cross-member of such U extends laterally across the front of the base 12 of toilet 10. Adjacent the free ends of the legs of the base 24 are mounted a pair of pivot brackets 26. Alternatively, the base and pivot brackets may be molded as a monolithic unit from plastic, preferably a bacteriostatic plastic.

Pivotally connected to each of the pivot brackets 26 is a piston and cylinder combination (hereinafter "cylinder") 28. The second end of each cylinder 28 is connected to a lift bar 30.

The lift bar 30 has a generally U-shaped configuration, and like the base 24, the crossbar of such U extends laterally across the front of the toilet, forward of the bowl 14, with the legs extending rearwardly towards the tank. The free ends of the legs of lift bar 30 are pivotally connected to the toilet 10 at a position in proximity to the pivot axis for the seat and cover 18 and 20.

In particular, a preferred arrangement will provide a pivot bracket 32 in the form of a substantially flat piece of metal which may be placed below, and secured by, the standard pivot supports for seat 18 and cover 20. The lateral ends of pivot bracket 32 include sockets 34 which are adapted to pivotally receive inwardly turned free ends of the legs of lift bar 30. As such, the lift bar 30 may pivot about the sockets 34.

As is best shown in FIG. 1, the legs of the lift bar 30 are formed of such a length that the crossbar of the lift bar 30 will engage the typical user at a point just behind the knee on the lower side of the leg. As such, pivotal movement of the lift bar 30 in a clockwise direction in FIG. 1 may lift the legs of the user upwardly, placing the user in a proper crouched position. As an added benefit, this length of the legs of lift bar 30 will result in the crossbar of the lift bar 30 being placed in an unobtrusive position when the lift bar is pivoted counter clockwise to an inoperative position, as shown by the dashed lines in FIG. 1. At the least the crossbar will be unobtrusive, and in many cases will actually be spaced inwardly of the forwardmost portion of the bowl.

Movement of the lift bar 30 between the operative and inoperative positions is accomplished by the cylinders 28, which are pivotally connected to the legs of the lift bar forward of the sockets 34. These cylinders may be actuated by hydraulics, compressed air, or pressurized water. To allow such actuation, each of the cylinders is provided with a pair of control conduits 36, through which the actuating fluid may flow, which are also connected to a pressure source 38 which may be a compressor, pump, or other mechanism. Control of the pump 38, and thus the cylinders 28, may be affected by means of a switch box 40 mounting an appropriate switch (not shown) and being operatively connected to the pump 38 by means of line 42.

As an alternative to double acting piston and cylinder combinations, single acting cylinders having spring return may be employed. As before, the pump would provide a source of pressurized air or water (or the plumbing water inlet could provide the pressurized water source) for the powered stroke, but here a valve arrangement would vent the pressurized side of the piston when it is desired to move the cylinder in the opposite direction (typically to expand the cylinder). Where water is employed as the pressure fluid, an exit conduit would pass from the cylinder to the interior of the toilet bowl to allow the pressurizing water to vent into the toilet. Pressurizing air could simply be vented to atmosphere.

To provide additional comfort to the user, the crossbar portion of the lift bar 30 may be provided with a pad 44, typically consisting of a resilient foam core and a plastic outer covering.

Figure 4:
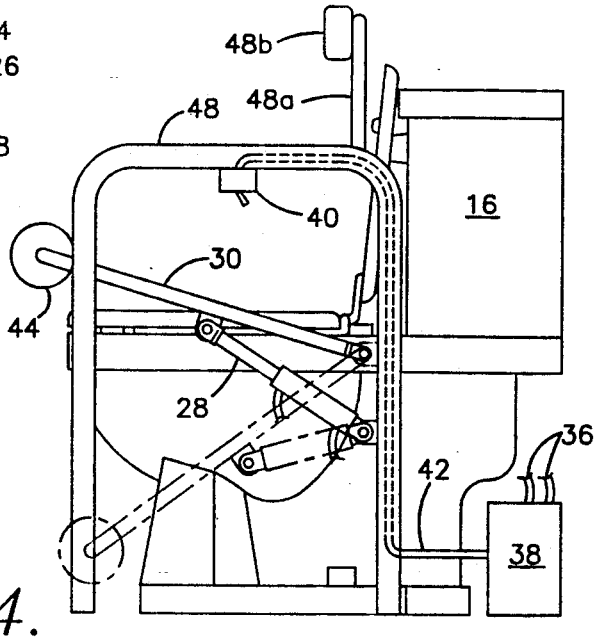
FIG. 4 is a side view of a second embodiment according to the present invention.
Figure 5:
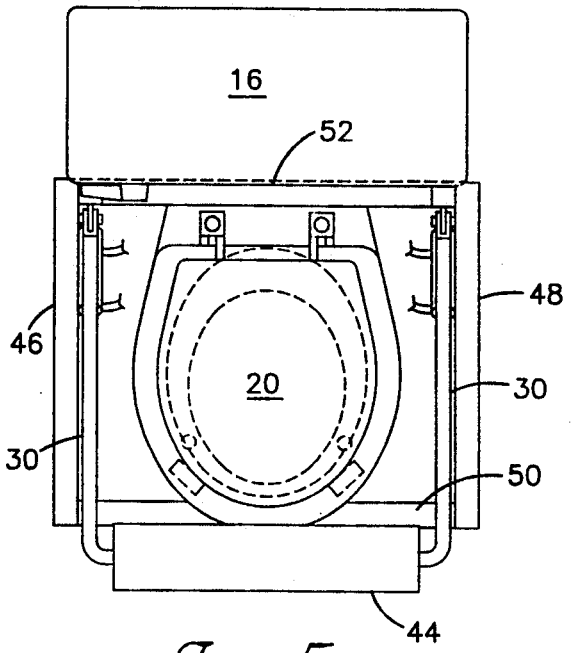
FIG. 5 is a top view of the second embodiment of FIG. 4.

With reference to FIGS. 4 and 5, a second embodiment according to the present invention is shown. This embodiment is a modification of the first embodiment shown in FIGS. 1-3. In particular, this embodiment operates on a similar principal, but eliminates a need for user modification of the seat and lid hinge assembly.

In this embodiment, there are provided first and second side frames 46 and 48 which are maintained in a spaced substantially parallel position by the use of a front brace 50 and a rear brace 52. The front and rear braces extend between and are rigidly connected to the side frames. The front brace 50 is preferably located adjacent the bottom front of the side frames while the rear brace is located at a position spaced above the floor, such that it will be located behind and in proximity to the hinge assembly for the seat 18 and cover 20 of the toilet, when the device is in the operative position shown in FIGS. 4 and 5.

The side frames and braces may be formed of metal, such as aluminum or may be formed of a plastic such as high density polyethylene. Although not necessary, it is preferred that the side frames extend upwardly a sufficient distance that they may act as arm rests and supports to aid the user in mounting and dismounting the toilet 10. The device may also be provided with a back rest. This may be in the form of a downwardly concave bar **48*a* fixed at both ends to the side frames. The concave configuration will preferably allow the toilet lid to open and close freely. A back pad 48*b* is mounted to the bar 48*a*** at a position to be engaged by the back of the user when seated on the toilet. Use of the back rest may provide additional comfort, while still maintaining the user in the proper crouched position.

The free ends of the legs of the lift bar 30 are pivoted to the side frames 46 and 48, as is the first end of the cylinders 28. As in the previous embodiment, the second end of the cylinders 28 are pivoted to the lift bar 30. One of the side frames may also be used as a mount for the switch box 40 to control the pump 38 via control line 42, with the pump being operatively connected to the cylinders 28 by control conduits 36.

While the side frames have been shown as U-shaped members in the figures, it should be apparent that various other configurations are possible. Such other configurations will allow pivoting of the lift bar and cylinders at different locations to provide more advantageous results, such as reduced cylinder length, reduced cylinder capacity needed, or others. While the lift bar 30 may be pivoted at numerous points, it is preferred that its pivot be located in proximity to the hips of the user when in the seated position, so that the cross bar of the lift bar 30, and possibly pad 44, will be provided with a motion corresponding to the legs of the user.

Figure 6:
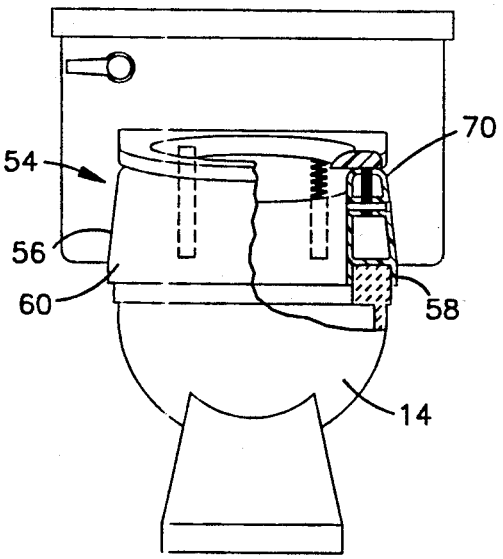
FIG. 6 is a front view of a third embodiment according to the present invention.
Figure 7:
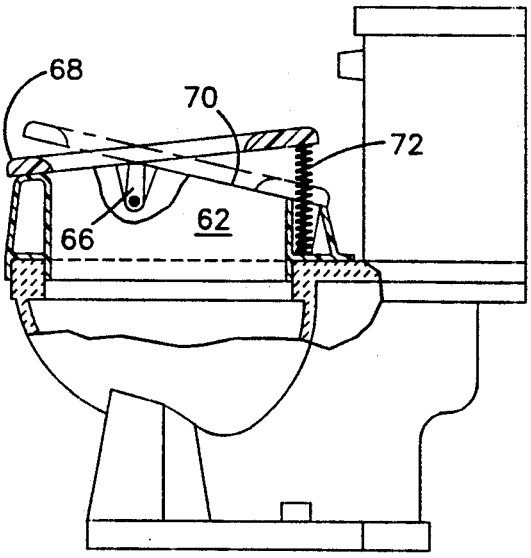
FIG. 7 is a side view in partial cross section of the third embodiment of FIG. 6.

With reference to FIGS. 6 and 7, a third embodiment of the present invention is generally designated by reference numeral 54. The device 54 takes the general form of a stool riser and includes an extension body 56 having a lower end 58 which engages with the rim of bowl 14. This engagement preferably includes wrapping about at least one of the inner or sides of the rim to make the engagement quite secure to ensure that the device 54 does not inadvertently slide from the toilet. The extension body 56 includes a peripheral wall 60 which is generally annular or elliptical in shape and defines a central passage 62. A hinge pin 64 extends through the wall 60 at two lateral locations to define a hinge axis which is substantially horizontal and parallel to the front face of tank 16. Pivotally mounted on the hinge pin 64 is a pivot bracket 66 which in turn mounts a pivot seat 68.

The peripheral wall 60 includes an upper edge 70 which has at least one portion which extends at an angle with respect to a horizontal plane. This is best shown in FIG. 7. Preferably, both the portions rearward of the hinge pins 64 and the portion forward of the hinge pins 64 taper downwardly. This will allow the pivot seat 60 to be moved between first and second positions engaging the upper edge 70 of wall 60. As is illustrated in FIG. 7 by dashed lines, the first position will cause the pivot seat 68 to tilt downwardly at the rear and upwardly at the front, which would move a user seated thereon into the proper crouched position. In the second position, shown in solid lines in FIG. 7, the pivot seat 68 has been pivoted upwardly in the rear which provides a helpful position for mounting and dismounting the pivot seat 68.

To assure that the pivot seat remains in the second position when not in use, such that it may be easily mounted, there may be provided one or more springs 72 engaged between the rear end of pivot seat 68 and extension body 56. The springs 72, of course, do not need to be coil springs as shown in the figures, but may be leaf or other types of springs. Additionally, any resilient material may act as the springs 72, such as a resilient foam material.

As an alternative to the spring 72, there may be provided an air or fluid bladder or bellows upon which the pivot seat 68 rests, with the air bladder having a restricted opening such that it will act as an air spring. It is preferred that this restriction valve operate in only a single direction such that movement of the pivot seat from the solid line position to the dashed line position in FIG. 7 is a relatively slow process, while rotation in the opposite direction is unimpeded. Such a restriction upon rotation may also be provided in the spring arrangement, by the addition of a dash pot.

It could also be possible to provide two bladders for use with this embodiment. In particular, a first bladder would be located adjacent the rear of pivot seat 86 with a second bladder located adjacent the front of pivot seat 86. These bladders would be connected by an appropriate conduit allowing the passage of air or fluid. In this situation, the movement of the rear of the pivot seat downwardly to the dashed position would compress the first bladder, causing air to enter the second bladder, expanding this second bladder. This expansion would aid in the lifting of the forward portion of the pivot seat. A similar action would take place when the user leans forward for dismounting from the toilet and compresses the forward second bag, thus causing expansion of the rear first bag. In this arrangement, it is believed that a spring 72 or other resilient means may still be required to maintain the pivot seat in the solid line position of FIG. 7 when not in use.

It is also possible to form these two bladders of different volumes or configurations such that the pressures exerted by the bladders against the underside of the pivot seat 68 are different. This may be used to tailor the lifting force for the user's legs to be sufficient for lifting, yet easily overcome when the user desires to dismount the device.

To provide a power assistance feature, the springs 72 may be replaced with piston and cylinder combinations similar to cylinders 28 along with associated control lines, pumps, and switches. In such a situation, the hinge pins 64 may be located very near the front of the extension body 56. However, where a biasing means such as springs 72 are employed, it is preferred that the hinge pins be spaced rearwardly of this front. This is so the user may apply weight upon the pivot seat forward of the pivot bracket 66, by shifting forward on the seat, and aid in the pivoting of the pivot seat to the inoperative position. This will aid in mounting and dismounting of the device, as many individuals, particularly the elderly, may find it difficult to mount and dismount the device in the operative position shown in dashed lines.

To improve sanitation of the device, it is preferred that the pivot seat 68 be provided with inner and outer depending skirts (not shown) which extend at least slightly below the upper edge 70 of the extension body 56 regardless of the pivot seat position. This will ensure that no wastes are ejected outwardly of the device through the space between the pivot seat and the upper edge 70 of the extension body, and that no waste will be lodged in the interior of extension body 56.

Figures 8, 9, 10, 11, 12:
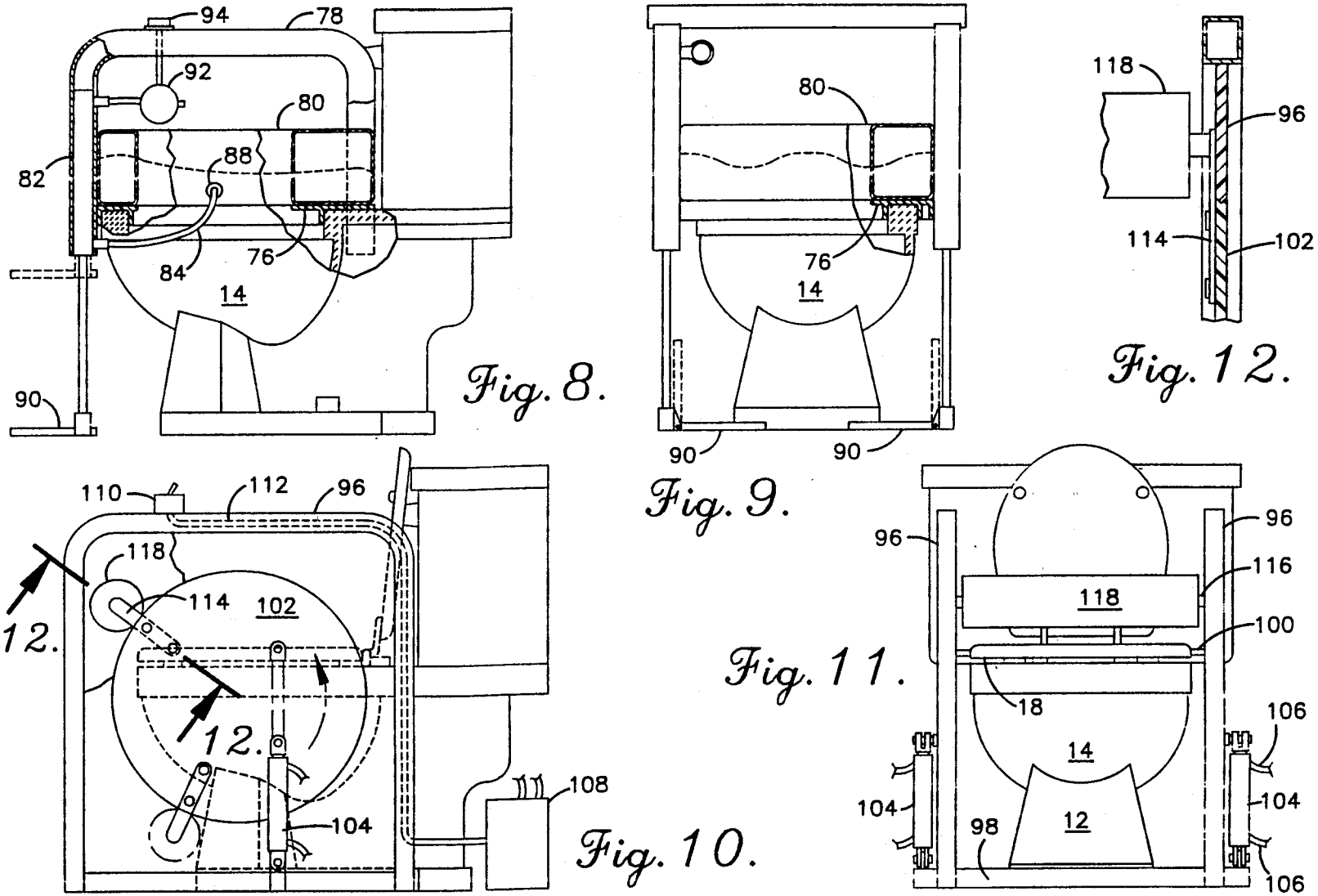
FIG. 8 is a side view in partial cross-section of a fourth embodiment of the present invention.
FIG. 9 is a front view in partial cross-section of the embodiment of FIG. 8.
FIG. 10 is a side view of a fifth embodiment according to the present invention.
FIG. 11 is a front view of the embodiment of FIG. 10.
FIG. 12 is a detail view in partial cross-section of the embodiment of FIG. 10.

With reference to FIGS. 8 and 9, a fourth embodiment of the present invention is generally designated by reference numeral 74. This embodiment includes a rim base 76 which extends about, and engages with, the periphery of the rim of bowl 14, as in the previous embodiment. Mounted to the rim base 76 are a pair of cylinder frames 78. These cylinder frames are arranged at each lateral side of the bowl 14 and may be configured to provide arm rests and supports to aid the user in mounting and dismounting the device, as with the side frames 46 and 48 above.

Also mounted upon the rim base 76 is an annular bladder 80 having a size and shape corresponding to the rim and bowl 14. The bladder 80 is defined by an air impermeable outer covering of resilient material surrounding a cavity, which may include a resilient foam core.

As the user sits upon the bladder 80, the bladder will be compressed (as indicated by dashed lines in FIGS. 8 and 9) and the fluid in the bladder subject to a higher pressure. This pressurized air or other fluid may be employed to drive a piston and cylinder combination (hereinafter "cylinder") 82 mounted to, and preferably within, each of the cylinder frames 78 adjacent the front of the toilet.

Mounted upon the lower end of each the rods of cylinders 82 is a foot rest 90. The user will place their feet upon the foot rests 90 prior to sitting upon bladder 80. The foot rests 90 may be rigidly fixed to the lower end of the piston rod of cylinder 82, but it is preferred that they be pivotally connected such that they may be moved to an inoperative position shown by dashed lines in FIG. 9.

As noted, when the user sits upon the bladder 80 their weight will increase the pressure within the bladder. This will cause air to pass through a conduit 84 into the lower portion of cylinder 82. An upper portion of cylinder 82 is open to atmosphere through a valve 92, and as such the piston of the cylinder will be driven upward, raising the foot rest 90. It is noted that the area of the piston within cylinder 82 is small compared to the area of the user in contact with the bladder, resulting in the foot rest being held in the upward position by a rather large force. This operative position with the bladder compressed and the foot rest raised is shown by dashed lines in FIG. 8. In this position the legs of the user will be lifted, placing the user in the proper crouched position.

To ensure that the foot rest is maintained in the upper position, the user may depress a push button 94, operatively connected to valve 92, causing the valve 92 to move to the closed position. As the valve 92 no longer allows the upper portion of cylinder 82 to communicate with atmosphere, attempts to move the foot rest 90 downward and thus expand this portion of the cylinder will create a vacuum in this upper portion, preventing such expansion.

When the user is ready to dismount the toilet, the push button 94 may be depressed to open the valve 92 to atmosphere. The user may then lean forward placing pressure upon the foot rests 90 while relieving pressure upon the bladder 80. This will cause the air in the lower portion of the cylinder to pass into the bladder 80, causing it to expand and thus aid the user in dismounting. As the upper portion in cylinder 82 is opened to atmosphere there is no resistance against the lowering of the foot rests and expansion of the bladder.

Rather than individual foot rests 90, this embodiment may employ a single platform extending between the piston rods of the cylinders 82. Alternatively, the piston rods could be connected to a lift bar adapted to engage the user at the back of the legs behind the knees to lift the legs and thereby place the user in a crouched position. In such a situation, the location of the cylinders would have to be raised with respect to that shown in FIGS. 8 and 9, or appropriate brackets connected to the piston rods of the cylinders to elevate the lifting pad to the proper position. Such a bracket would extend a short distance laterally inward of the toilet, then extend upwardly, back along the piston rod of the cylinder, to an end adjacent the piston. This would result in the lifting pad moving between positions below the bladder to above the bladder.

A fifth embodiment of the present invention is shown with reference to FIGS. 10–12.

In this embodiment the device includes a pair of side frames 96 located at lateral sides of the toilet bowl 14. It is preferred that the side frames 96 extend upwardly a sufficient distance such that they may be used as supports and arm rests. To aid in maintaining the side frames in their spaced opposed configuration, a front brace 98 extends between the side frames at a lower position adjacent the front of the side frames, and a rear brace 98 extends between the side frames at a position above the bowl 14 and behind the seat 18.

The side frames 96 are preferably substantially solid and serve as supports or bearings for lift disks 102. As is best shown in FIG. 12, the lift disks and side frames include a dovetail configuration at their intersection, such that the lift disks are prevented from movement laterally of the side frames, but may rotate within the plane of the side frames. For ease of assembly, this dovetail configuration may be achieved by forming each lift disk as a pair of disk members, each having an oblique periphery such that the disks are substantially trapezoidal in cross-sectional configuration. By placing a disk member to each side of a side frame and then securing the disk members together, the desired dovetail configuration may be achieved.

The lift disks are rotated within the side frames by use of a piston and cylinder combination (hereinafter cylinder) 104. In particular, a lower end of the cylinder is pivoted to the side frame 96, while an upper end of the cylinder is pivoted to the lift disk 102 at a position spaced from the center of the lift disk. As in previous embodiments, the cylinders are each provided with control conduits 106 which are operatively connected to a pump 108. A switch box 110 is provided and is connected by a line 112 to the pump 108 for controlling the pump. The switch box 110 is preferably located at a convenient position upon the side frames for easy access by the user.

Each of the lift disks 102 include a mounting bracket 114 connected to the opposed or inner faces of the lift disks. The mounting brackets 114 are not connected to the side frames 96 such that rotation of the lift disks is not impeded. Fixed to and extending between the mounting brackets 114 is a lift bar 116. The lift bar may be provided with a surrounding resilient pad 118 for additional comfort to the user.

The operation of this embodiment is best shown in FIG. 10. In the initial configuration shown in dashed lines, the cylinder will be in an extended position with the mounting brackets 114, and thus lift bar 116, being at a lowered position adjacent the base 12 of the tank. In this position the lift bar 116 does not interfere with normal use of the toilet.

After the user has been seated upon the seat 18, the switch box 110 is activated to drive the pump 108. This will cause the cylinder 104 to contract, causing the lift disk 102 to rotate clockwise. This will move the mounting bracket and lift bar 116 clockwise, bringing the lift bar into contact with the back of the user's legs adjacent the knee, and with continued rotation to the fully contracted position of the cylinder, will lift the user's legs by the desired amount. This will place the user in the proper crouch position.

When the user is ready to dismount the toilet, the switch box 110 is again activated to drive the pump 108, causing the cylinder to move from the contracted to the expanded position. As should be apparent, this will move the lift bar 116 counter-clockwise and to the lower position. As such, the user will be moved out of the crouched position and may readily dismount the toilet.

Figure 13:
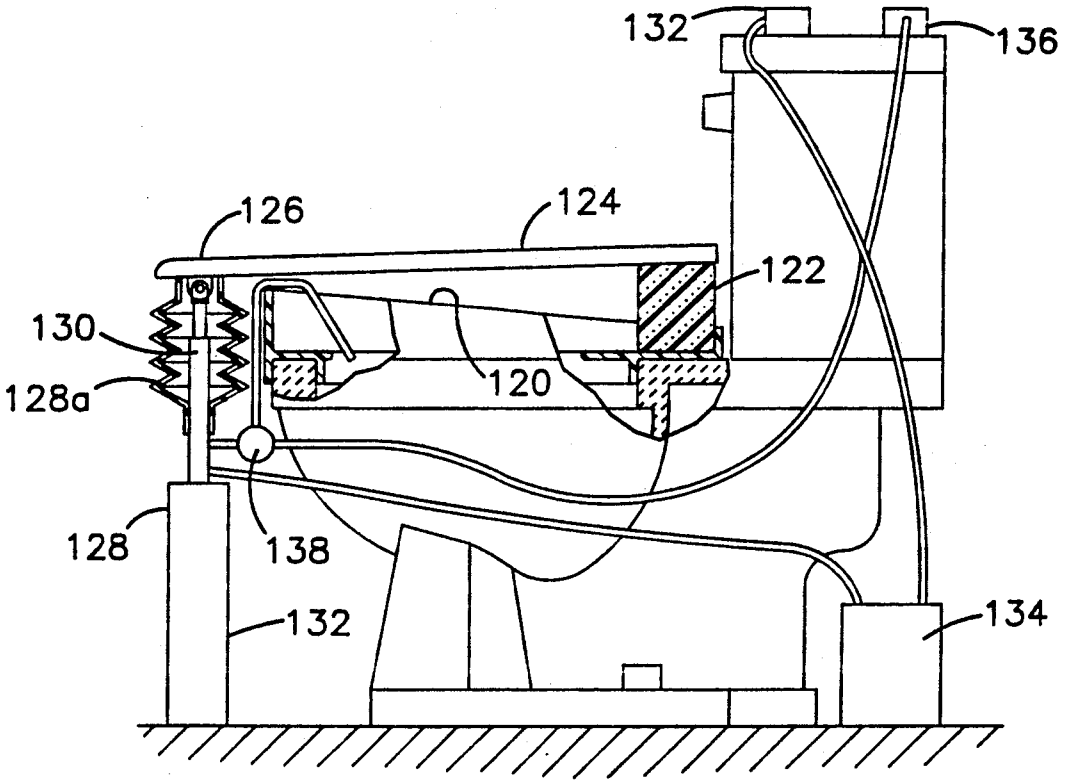
FIG. 13 is a side view of a sixth embodiment of the present invention.

Yet another embodiment is shown in FIG. 13. This embodiment includes a rim base 120 as in previous embodiments, but includes a generally downward tilt of the upper edge towards the rear of the rim base. Supported near the rear of the rim base is a resilient foam block 122. The foam block 122 in turn supports a rear portion of a seat 124. The seat 124 is similar to typical seats, and includes an opening for the passage of waste, but includes at least one forward extension 126 which extends outwardly beyond the periphery of the rim of the toilet bowl.

Mounted below, and providing support for, the forward extension 126 is a lift support 128. The lift support 128 generally consists of at least one piston and cylinder combination 130, double acting or single acting as in the previous embodiments. The upper end of cylinder 130 is preferably pivoted to the underside of the extension 126 for stability. The lower end of the cylinder 130 is supported by the ground. To reduce the required length of the cylinder, the cylinder 130 may be mounted on the upper end of a column 132 which rests upon the ground. For esthetics there may be provided a flexible shroud **128*a* which will conceal the cylinder 130**.

In use, the foam block 122 will compress under the weight of the user, lowering the rear of the seat. The user may then pres a switch 132 operatively connected to a pump 134 providing a source of pressurized fluid, such as air or water. Activation of the pump will cause the pressurized fluid to flow into the cylinder, causing it to expand. This will raise the forward portion of the seat, placing the user in the proper crouched position. When the user desires to dismount, a second switch 136 may be pressed to open a vent valve 138, which allows the pressurized fluid in the cylinder to vent therefrom, possibly into the toilet bowl. Contraction of the cylinder is caused by the weight of the user, possibly assisted by a spring.

It is possible to modify this embodiment to operate similar to the two air bladder embodiment described above with respect to FIGS. 8 and 9. This arrangement may be preferred, as the rear air bladder could be reinflated by compression of the front bladder (caused by the user shifting their weight forward). This will cause the seat to attain a more level position during dismount.

It should be apparent to those skilled in the art that the present invention will place the user in the proper physiologic position for bowel movement. Additionally, many of the embodiments described above are separate from the toilet, and may be placed in position and removed as a unit. Those embodiments which are not separate from the toilet could be modified to be so, where desired. The embodiments shown herein may also be modified by provision of self-supporting legs (where needed), and a seat (where needed), and a removable chamber pot beneath the opening in the seat. Such an arrangement would be similar to existing portable chamber pot commodes, but provide the advantages of the present invention. In particular, this will provide the ability to achieve the proper crouched position in a portable commode which may be placed near a patients bed or in other positions.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A toilet device for raising the legs of a user relative to the trunk of the user, comprising:

an extension body having a lower end adapted to engage with a rim of a bowl of the toilet, and a peripheral wall extending upwardly from said lower end and defining a passage therethrough for waste; and a pivot seat mounted on said extension body, said pivot seat having a seat portion adapted to engage with the buttocks of the user including a forward end in close proximity to the user's knees and a rear end in close proximity to the user's tailbone, when the user is sitting thereupon, and including a passage therethrough for waste, said seat portion being pivotally mounted to said wall of said extension body for pivoting about an axis substantially horizontal and substantially lateral of the toilet, said axis being located substantially centrally of said forward and rear ends of said seat portion, whereby said pivot seat may be pivoted between first and second positions, in said first position a front portion of said pivot seat being vertically below a rear portion of said pivot seat, and in said second position a front portion of said pivot seat being vertically above a rear portion of said pivot seat.

2. An attachment as in claim 1, further including biasing means for resiliently biasing said pivot seat to said first position.

3. An attachment as in claim 1, wherein said extension body includes an upper edge, at least a portion of which defines an abutment for said pivot seat when said seat is in said first and second positions.

* * * * *